United States Patent [19]

Arnott

[11] 4,062,116

[45] Dec. 13, 1977

[54] FABRIC CUTTING TOOL

[76] Inventor: Gertrude V. Arnott, 314 N. 7th St., Delavan, Wis. 53115

[21] Appl. No.: 756,994

[22] Filed: Jan. 5, 1977

[51] Int. Cl.[2] ..... B26B 29/00

[52] U.S. Cl. ..... 30/292; 30/319

[58] Field of Search ..... 30/292, 319, 275, 276

[56] References Cited

U.S. PATENT DOCUMENTS

| | | | |
|---|---|---|---|
| 717,030 | 12/1902 | Sager | 30/292 |
| 3,048,921 | 8/1962 | Johnson | 30/292 |

FOREIGN PATENT DOCUMENTS

| | | | |
|---|---|---|---|
| 9,275 of | 1891 | United Kingdom | 30/292 |

*Primary Examiner*—James L. Jones, Jr.
*Attorney, Agent, or Firm*—Charles J. Speciale

[57] ABSTRACT

A fabric cutting tool comprising an elongated shank curved and bifurcated at one end and a handle on the other, the bifurcated end having a spring loaded rotary cutting blade rollingly mounted between the bifurcation, a protective shield for the blade, a pair of guide wheels for assisting in the cutting, and a foot plate providing a cutting surface for the fabric.

9 Claims, 5 Drawing Figures

FABRIC CUTTING TOOL

BACKGROUND OF THE INVENTION

1. Field of the Invention

This invention relates to new and useful improvements in tools for cutting and trimming fabric.

2. Description of the Prior Art

Fabric cutting requires a steady hand whether cutting on a straight line or on a curved line. Any tool that will assist in accomplishing this will, of course, be a boon to the sewing art. A rotary cutter has been attempted by those in the fabric art, noodle art, pastry art and the linoleum art, for example such as those in U.S. Pat. Nos. 406,821; 648,791; 690,489; 963,682; 1,321,215; 1,758,328; and 2,684,533. None of the foregoing disclose the improved tool of this invention involving an elongated shank curved and bifurcated at one end, with a spring loaded rotary cutting blade, a protective shield, a pair of guide rollers and a cutting surface all on one tool.

SUMMARY OF THE INVENTION

It is, therefore, among one of the principal objectives of this invention to provide an improved fabric cutting tool employing a rotary cutter over the prior art.

In accord with the invention, there is now provided a fabric cutting tool comprising an elongated shank curved and bifurcated at one end and a handle provided on the other, the bifurcated end having a spring loaded rotary cutting blade rollingly mounted between the bifurcation, a protective shield over the cutting blade, a pair of guide wheels bracketing the bifurcated end and cutting blade and a foot plate providing a cutting surface for the fabric.

BRIEF DESCRIPTION OF THE DRAWING

The invention will be hereinafter more fully described with reference to the accompanying drawing in which.

DESCRIPTION OF THE PREFERRED EMBODIMENTS

Figure 1:
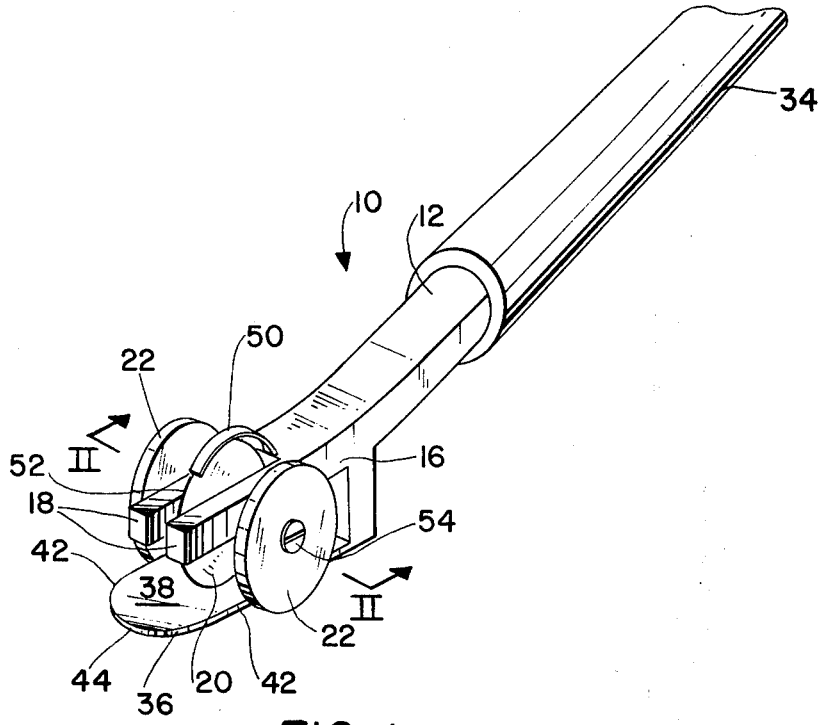
FIG. 1 is a view in perspective of the invention fabric cutting tool.
Figure 2:
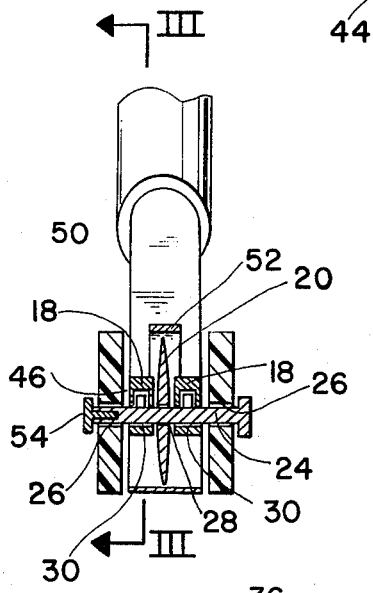
FIG. 2 is a sectional fragmented view taken along line 2—2 of FIG. 1.
Figure 3:
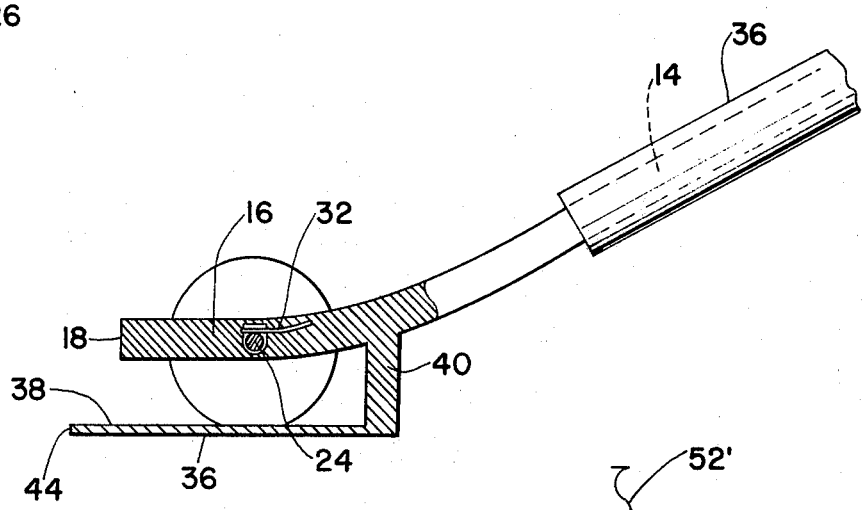
FIG. 3 is a view similar to FIG. 2 taken along line 3—3 of FIG. 2.

Referring now to the figures of the drawing, there is illustrated therein, the fabric cutting tool 10 of the invention (hereinafter referred to as "tool"). Tool 10 comprises an elongated shank 12 having a linear main body portion 14 and an upwardly curved end portion 16. Curved end portion 16, further, is bifurcated to provide a pair of spaced branches 18. Mounted between the two branches 18 is a straight edge rotary cutter 20, and in turn a pair of guide wheels 22 bracket the branches 18, a central axle 24, passing through the center openings 26 in the guide wheels and through the center opening 28 of the rotary cutter 20 and through the branches 18 through their openings 30 provided for that purpose, adapting the rotary cutter and guide wheels to be rollingly mounted to the branches 18. Preferably, a leaf spring 32 in each branch 18 urges the central axle 24 downwardly, and in turn the rotary cutter 20, against the fabric to provide a better cut. A handle 34 of rubber or plastic is provided on the main shank portion 12.

In addition to the foregoing, with respect to the bifurcated end 16 of the tool, their is provided a foot plate 36 which serves as a cutting surface 38 for the fabric. Foot plate 36 is mounted to the curved end 16 via a downwardly extending member 40 from said curved end. Foot plate 36 has a pair of parallel opposing sides 42 and a leading curved portion 44. The opposing sides 42 are between the guide wheels 22 and are flush with the outer walls 46 of the branches 18. Tool 10 is of suitable metal such as stainless steel and can be machined as a unitary body with respect to the shank portion 12, the curved end 16, and the foot plate 36. Wheels 22 and rotary cutter 20 are separately mountable as has been described and can be of a metal similar to the rest of the tool. The rotary cutter can be of stainless steel or chrome steel.

Figure 4:
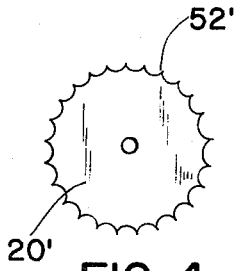
FIGS. 4 and 4*a* show another type of rotary cutter that may be used with the present tool in elevated plan view and end view, respectively.
Figure 4A:
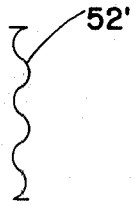

A curved protective shield 50 is mounted to the curved end 16 of the tool which covers the naked cutting edge 52 of the rotary cutter 20. Still further, referring specifically to FIGS. 4 and 4*a*, a rotary cutter 20 having a crimped cutting edge 52' can be mounted to the tool instead of the straight edge cutting tool 20. This crimped cutting edge will yield a cut similar to that made with conventional pinking shears, except that it will give a cleaner zig-zag cut without chewing the fabric or clogging the blades as the conventional pinking shears. Rotary cutter 20' can be provided on a separate tool, or the tool 10 can be made such that the central axle 24 will be removable by means of a suitable screw 54 so that the cutting blades 20 and 20' can be interchangeable. In the latter instance, the leaf spring 32 would have to be omitted, so this modification is less preferable.

In order to cut a fabric, all that need be done is to place the leading edge of the fabric on the cutting surface 38 of the foot plate 36 just under the cutting edge 52, and then push forward using the wheels 52 as a rolling guiding aid as well as for balance. The present cutting tool is particularly suitable for cutting knits and synthetic fabric.

What is claimed is:

1. A fabric cutting tool comprising an elongated shank having a straight main body portion and an upwardly curved bifurcated end portion, said bifurcated end portion having a rotary cutter rollingly mounted between the bifurcation, a protective shield over said rotary cutter, a pair of guide wheels bracketing said bifurcated end portion and acting in rolling association with said rotary cutter and a foot plate providing a cutting surface for the fabric extending under said curved end portion.

2. A fabric cutting tool according to claim 1 wherein said bifurcated end portion forms a pair of spaced branches, said rotary cutter being positioned between said branches, a central axle passing through said spaced branches and through said rotary cutter and said guide wheels adapting said rotary cutter and guide wheels to act in rolling association.

3. A fabric cutting tool according to claim 1 wherein a handle of non-slip material is provided on said main body portion.

4. A fabric cutting tool according to claim 2 wherein said rotary cutter is straight edged and is mounted in spring loaded relation with said central axis, the spring loading causing said central axle to be urged downwardly and in turn said rotary cutter against the fabric to be cut.

5. A fabric cutting tool according to claim 2 wherein said rotary cutter has a crimped cutting edge.

6. A fabric cutting tool according to claim 2 wherein said central axle is removable to allow for interchanging rotary cutters.

7. A fabric cutting tool according to claim 1 wherein said elongated shank and foot plate are formed of a unitary body.

8. A fabric cutting tool according to claim 7 wherein said foot plate has a pair of parallel opposing sides and a leading curved end portion insertable under said fabric, said opposing sides fitting between said guide wheels and consistent with the width of said elongated shank.

9. A fabric cutting tool according to claim 4 wherein a leaf spring in each of said spaced branches urges said central axle downwardly.

* * * * *